US010960523B1

(12) United States Patent
Connors

(10) Patent No.: US 10,960,523 B1
(45) Date of Patent: Mar. 30, 2021

(54) NAIL DRIVING TOOL

(71) Applicant: Barry Connors, Hartford (CA)

(72) Inventor: Barry Connors, Hartford (CA)

( * ) Notice: Subject to any disclaimer, the term of this patent is extended or adjusted under 35 U.S.C. 154(b) by 0 days.

(21) Appl. No.: 16/541,682

(22) Filed: Aug. 15, 2019

(51) Int. Cl.
*B25C 1/02* (2006.01)
*B25C 1/00* (2006.01)

(52) U.S. Cl.
CPC ..... *B25C 1/02* (2013.01); *B25C 1/008* (2013.01)

(58) Field of Classification Search
CPC ..... B25C 1/02; B25C 1/008; B25J 15/10
USPC ..... 227/147
See application file for complete search history.

(56) References Cited

U.S. PATENT DOCUMENTS 329,278 A * 10/1885 Copeland ..... B25C 1/02 227/147
1,127,838 A * 2/1915 Willers ..... B25C 1/02 227/147
1,575,582 A 3/1926 Joy
2,430,532 A * 11/1947 Rayburn ..... B22C 21/14 227/142
2,587,944 A 3/1952 Williams
2,624,879 A 1/1953 Baird
2,641,379 A * 6/1953 Barbaro ..... B21J 15/041 29/402.08
2,727,235 A 12/1955 Griffiths
2,767,399 A 10/1956 Maston
3,060,440 A * 10/1962 Pfaff et al. ..... B25C 1/02 227/147
3,695,499 A * 10/1972 Taylor ..... B21J 15/041 227/52
D235,968 S 7/1975 Mein
3,979,040 A * 9/1976 Denin ..... B25C 1/02 227/113
4,065,045 A * 12/1977 Pray ..... B25C 1/02 227/147
4,179,058 A * 12/1979 Yost ..... B25C 3/002 227/147
D273,759 S 5/1984 Drori
4,519,536 A * 5/1985 Steigauf ..... B25C 1/00 227/147
4,676,424 A * 6/1987 Meador ..... B25C 1/02 227/147
D314,127 S 1/1991 Williamson et al.
5,529,234 A * 6/1996 Juneau ..... B25C 1/02 227/147
6,036,073 A * 3/2000 Newhouse ..... B25C 1/02 227/119
6,345,755 B1 * 2/2002 Fields ..... B25C 1/02 227/119
7,775,412 B2 * 8/2010 Nemeth ..... B25C 1/02 173/90

* cited by examiner

*Primary Examiner* — Andrew M Tecco
(74) *Attorney, Agent, or Firm* — Cramer Patent & Design, PLLC; Aaron R. Cramer

(57) ABSTRACT

A nail driving tool is fashioned as a cylindrical member having an interior void through which a pin is capable of partial movement. The pin is secured within the cylindrical unit by a knob disposed through the cylindrical member, thereby keeping the pin from being fully ejected therefrom. The tool is capable of securing a nail at a first end and upon a force delivered to the pin, driving the nail in a workpiece.

12 Claims, 5 Drawing Sheets

NAIL DRIVING TOOL

RELATED APPLICATIONS

Not applicable.

FIELD OF THE INVENTION

The present invention relates generally to nail driving tools.

BACKGROUND OF THE INVENTION

As anyone who performs a lot of construction or building work will attest, there is perhaps no more useful tool than the hammer and nail. They are used in all phases of construction from initial rough in carpentry work to final detailing finishes. They have been around and in use since almost the beginning of mankind and have remained little changed over the years. However, one disadvantage of their use is that require a fair amount of access around the nail driving point for the hammer to swing.

As such, they cannot be used in tight locations that have access restrictions not only around the nail itself, but above the nail to allow the hammer to swing. In some cases, pneumatic nail guns may not have access room either thus forcing the worker to approach the construction problem from a completely different manner, often at the cost of additional time and labor. Accordingly, there exists a need for a means by which conventional nails can be easily driven in tight locations with a hammer and without the problems as described above. The development of the nail driving tool fulfills this need.

SUMMARY OF THE INVENTION

The inventor has recognized the aforementioned, inherent problems and lack in the art and observed that there is a need for a nail driving tool, comprising an outer sleeve having an inner pin that slides back and forth inside the outer sleeve, an upper end of the inner pin is provided with a striking head, an opposite end of the outer sleeve is provided with a nail head contact surface and one side of the outer sleeve is provided with a restriction slot which keeps the inner pin from being separated from the outer sleeve when the nail driving tool is placed with the striking head in a downward facing position. The striking head is driven by an impact blow which drives the inner pin through the outer sleeve until the nail head contact surface is completely driven out of the distal end of the outer sleeve for a predetermined distance. The inner pin is withdrawn from the outer sleeve by holding the outer sleeve while pulling the striking head along a withdrawal travel path until the retaining pin contacts an extended limit of the restriction slot. This creates a hollow cavity at the distal end of the outer sleeve as the nail head contact surface which permits a nail to be inserted. Once fully inserted the nail head is held in place by the magnetic nature of the nail head contact surface. The friction provided by the inner sleeve is adequate to hold the inner pin within the outer sleeve even if the nail driving tool should be inverted with the nail at the bottom—such friction is then overcome with the impact blow.

The nail driving tool also comprises a retaining pin which is slid from a retracted limit to an extended limit at an opposite end of the restriction slot and an inner sleeve filling an interstitial space between the outer sleeve and the inner pin to increase stability and keep dust and dirt from an interior of the nail driving tool and hindering operation thereof. The inner sleeve is visible at the lower junction between the outer sleeve and the inner pin as well as an interior of the restriction slot. The nail driving tool also comprises a strike guard which is located at an upper end of the outer sleeve is held in place with at least one retaining device. The strike guard is permanently attached to the outer sleeve.

The impact blow may be from a hammer. The predetermined distance may be one-quarter-of-an-inch which corresponds to a point where the retaining pin is at a retracted limit of the restriction slot. The predetermined distance may have an overall length of the nail driving tool making it ideal for transport. The restriction slot may be four inches long to accommodate a nail or a spike up to four inches long. The outer sleeve may be magnetized or not magnetized. The outer sleeve is made of a durable metal material such as steel or titanium. The outer sleeve is five-eighths of an inch in diameter. While the inner pin is three-eighths-of an-inch in diameter. The restriction slot may be four inches long to accommodate nails or spikes up to four inches long.

The retaining pin may be permanently attached to the inner pin by an attachment method selected from the group consisting of pressing, welding, threading, or gluing. The inner sleeve may be made of a hard plastic with a low coefficient of friction selected from the group consisting of polytetrafluoroethylene, polyimide, nylon, acetal, or polyester. The strike guard is intended to protect the user's hands against accidental miss-strikes during use and may be removed if needed. The strike guard may be permanently attached to the outer sleeve by welding. At least one retaining device may be a setscrew. The nail driving tool may be in the range of ten to thirty-six inches long.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
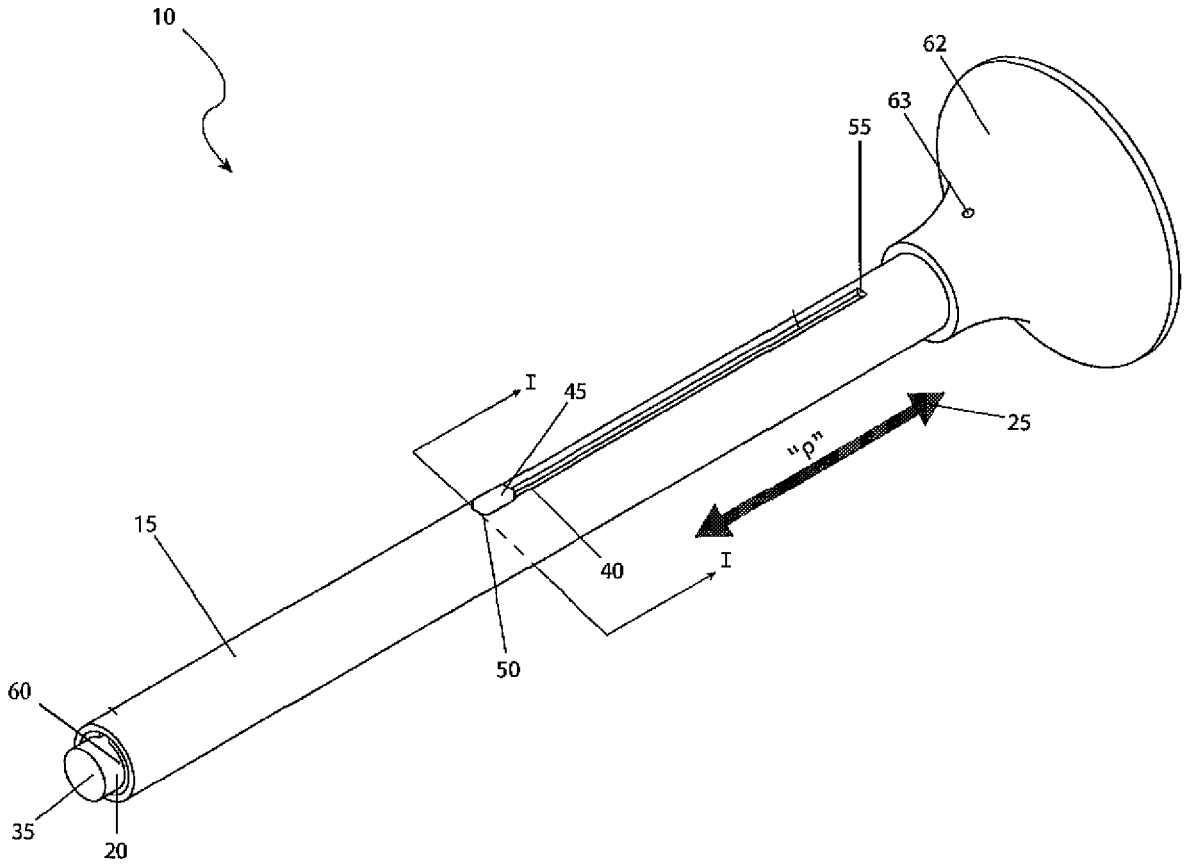
FIG. 1 is a perspective view of the nail driving tool 10, according to the preferred embodiment of the present invention.

10 nail driving tool
15 outer sleeve
20 innerpin
25 travel path "p"
30 striking head
35 nail head contact surf ace
40 restriction slot
45 retaining pin

50 retracted limit
55 extended limit
60 inner sleeve
62 strike guard
63 retaining device
65 impact blow
70 withdrawal travel path "ru"
90 user
95 hammer
100 preferred nailing location
105 obstacles
110 impact point

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a perspective view of the nail driving tool 10, according to the preferred embodiment of the present invention is disclosed. The nail driving tool 10 (herein also described as the "tool") 10, includes an outer sleeve 15 of which an inner pin 20 slides back and forth inside as indicated by a travel path "p" 25. The upper end of the inner pin 20 is provided with a striking head 30. The opposite end of the outer sleeve 15 is provided with a nail head contact surface 35, which may or may not be magnetized. It is envisioned that the outer sleeve 15 and inner pin 20 would be made of a durable metal material such as steel or titanium; however, the material of construction is not envisioned to be a limiting factor of the present invention. The overall dimensions of the tool 10 may vary per needs, however a typical size is envisioned to be approximately ten inches (10 in.) long at a minimum up to thirty-six inches (36 in.) at a maximum. The dimension of the outer sleeve 15 is envisioned to be five-eighths of an inch (⅝ in.) in diameter. The diameter of the inner pin 20 is envisioned to be three-eighths-of an-inch (⅜ in.). The diameter of the striking head 30 is envisioned to be one inch (1 in.) in diameter. As indicated however, the overall dimensions of the tool 10 are not intended to be a limiting factor of the present invention.

The side of the outer sleeve 15 is provided with a restriction slot 40 which keeps the inner pin 20 from being separated from the outer sleeve 15 when the tool 10 is placed with the striking head 30 in a downward facing position. The overall length of the restriction slot 40 is envisioned to be approximately four inches (4 in.) long to accommodate nails or spikes up to four inches (4 in.). Sliding action is accomplished by a retaining pin 45 which slides from a retracted limit 50 (as shown) to an extended limit 55 at the opposite end of the restriction slot 40. An inner sleeve 60, envisioned to manufactured from a hard plastic with a low coefficient of friction, such as PTFE (polytetrafluoroethylene), polyimide, nylon, acetal, or polyester, fills the interstitial space between the outer sleeve 15 and inner pin 20 to increase stability and keep dust and dirt from the interior of the tool 10 and hindering operation thereof. The inner sleeve 60 is visible at the lower junction between the outer sleeve 15 and the inner pin 20 as well as the at the interior of the restriction slot 40. A strike guard 62 is located at the upper end of the outer sleeve 15 and is held in place with at least one (1) retaining device 63, such as a setscrew. Alternately, the strike guard 62 can be more permanently attached to the outer sleeve 15 such as by welding. The strike guard 62 is intended to protect the user's hands against accidental miss-strikes during use. The strike guard 62 may be removed if needed for specific applications.

Figure 2:
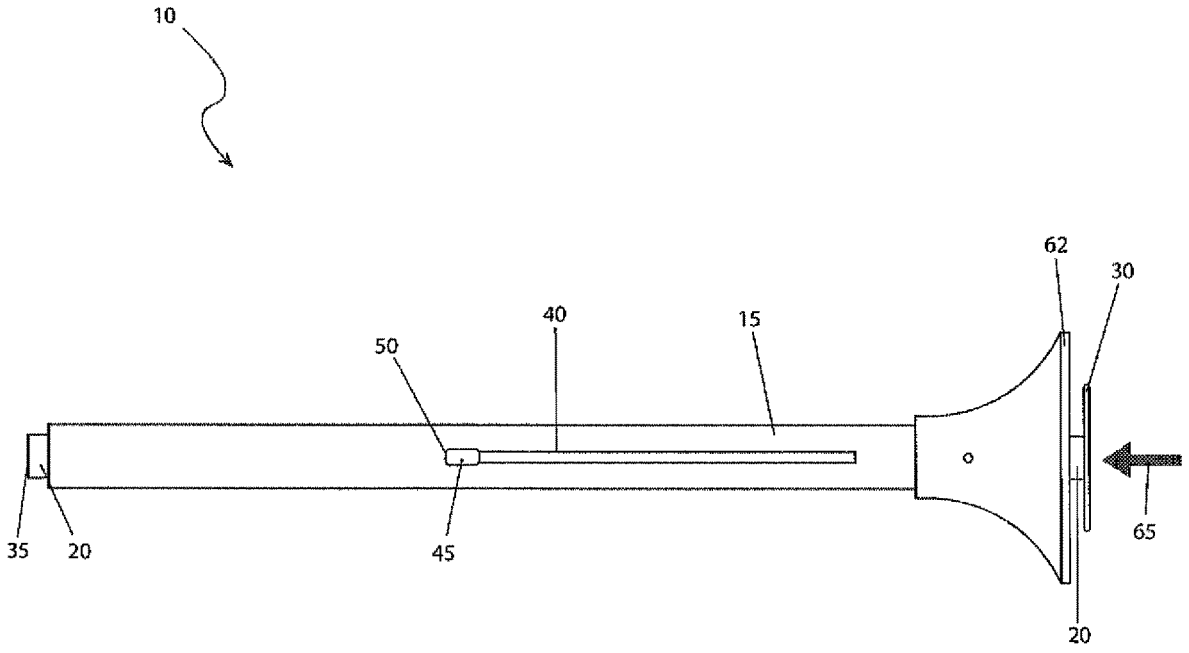
FIG. 2 is a side view of the nail driving tool 10, shown in a retracted state, according to the preferred embodiment of the present invention.

Referring next to FIG. 2, a side view of the nail driving tool 10, shown in a retracted state, according to the preferred embodiment of the present invention is depicted. This view, similar to that of FIG. 1, is the state of the tool 10 after use. The striking head 30 is driven by an impact blow 65, such as from a hammer, which drives the inner pin 20 through the outer sleeve 15 until the nail head contact surface 35 is completely driven out of the distal end of the outer sleeve 15 for a distance of approximately one-quarter-of-an-inch (¼ in.). This distance corresponds to the point where the retaining pin 45 is at the retracted limit 50 of the restriction slot 40. Additionally, this said configuration presents the lowest overall length of the tool 10 making it ideal for transport in a toolbox, tool belt, pocket, or the like. The strike guard 62 is visible at the upper end of the outer sleeve 15.

Figure 3:
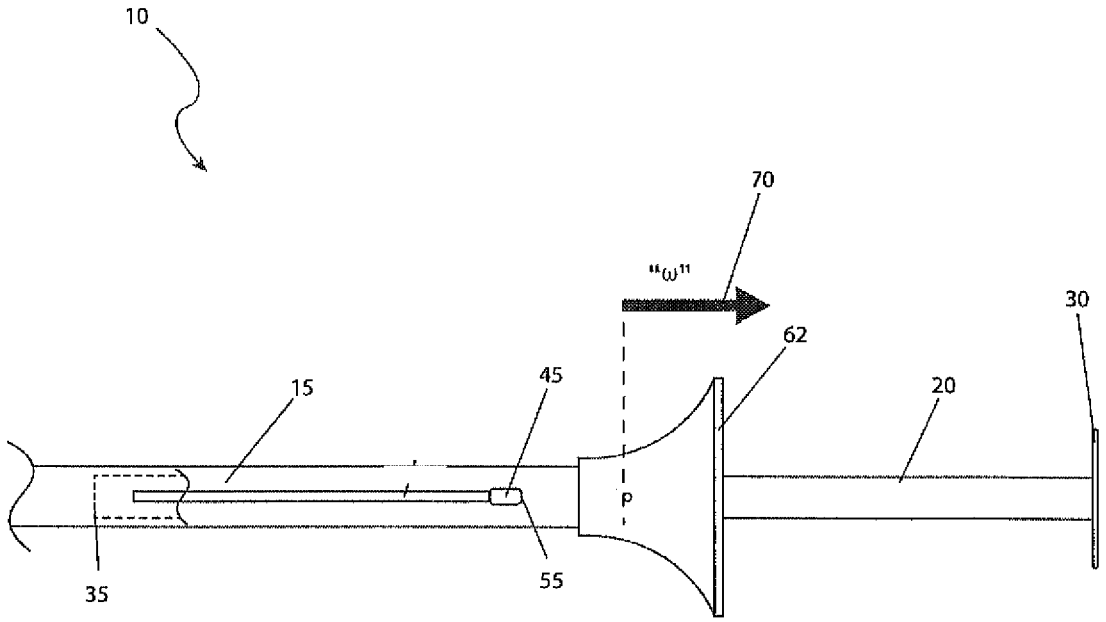
FIG. 3 is a side view of the nail driving tool 10, shown in an extended state, according to the preferred embodiment of the present invention.

Referring now to FIG. 3, a side view of the nail driving tool 10, shown in an extended state, according to the preferred embodiment of the present invention is shown. This state is evident during initial use of the tool 10. The inner pin 20 is withdrawn from the outer sleeve 15 by holding the outer sleeve 15 while pulling the striking head 30 along a withdrawal travel path "ru" 70 until the retaining pin 45 contacts the extended limit 55 of the restriction slot 40. This action creates a hollow cavity at the distal end of the outer sleeve 15 as the nail head contact surface 35 (here shown by a dashed line due to its hidden state) which permits a nail to be inserted or "loaded" (here shown partially inserted for purposes of illustration). Once fully inserted, the nail head may be held in place by the magnetic nature of the nail head contact surface 35 if so equipped. It is envisioned that the friction provided by the inner sleeve 60 is adequate to hold the inner pin 20 within the outer sleeve 15 even if the tool 10 should be inverted with the nail at the bottom Such friction is then overcome with the impact blow 65 (as shown in FIG. 2) during use. The strike guard 62 is visible at the upper end of the outer sleeve 15.

Figure 4:
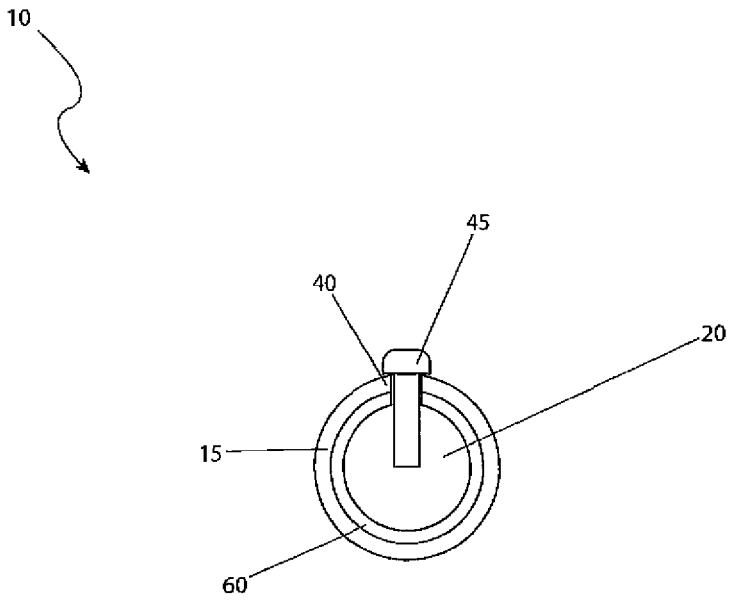
FIG. 4 is a sectional view of the nail driving tool 10 as seen along a line I-I, as shown in FIG. 1, according to the preferred embodiment of the present invention; and, FIG. 5 is a perspective view of the nail driving tool 10, shown in a utilized state, according to the preferred embodiment of the present invention.

Referring next to FIG. 4, a sectional view of the nail driving tool 10 as seen along a line I-I, as shown in FIG. 1, according to the preferred embodiment of the present invention is disclosed. This view discloses the retaining pin 45 permanently attached to the inner pin 20 by means of pressing, welding, threading, adhesive, or the like. The exact method of attachment between the retaining pin 45 and the inner pin 20 is not intended to be a limiting factor of the present invention. The retaining pin 45 rides within the restriction slot 40, present in the outer sleeve 15 as aforementioned described. The inner sleeve 60 is present between the outer sleeve 15 and the inner pin 20 for the entire circumference. The inner sleeve 60 provides for smooth operation of the tool 10 and allows for retainment of the inner pin 20 within the outer sleeve 15 at any point, while keeping contaminants, such as dust, dirt, sawdust, and the like out of the tool 10.

Figure 5:
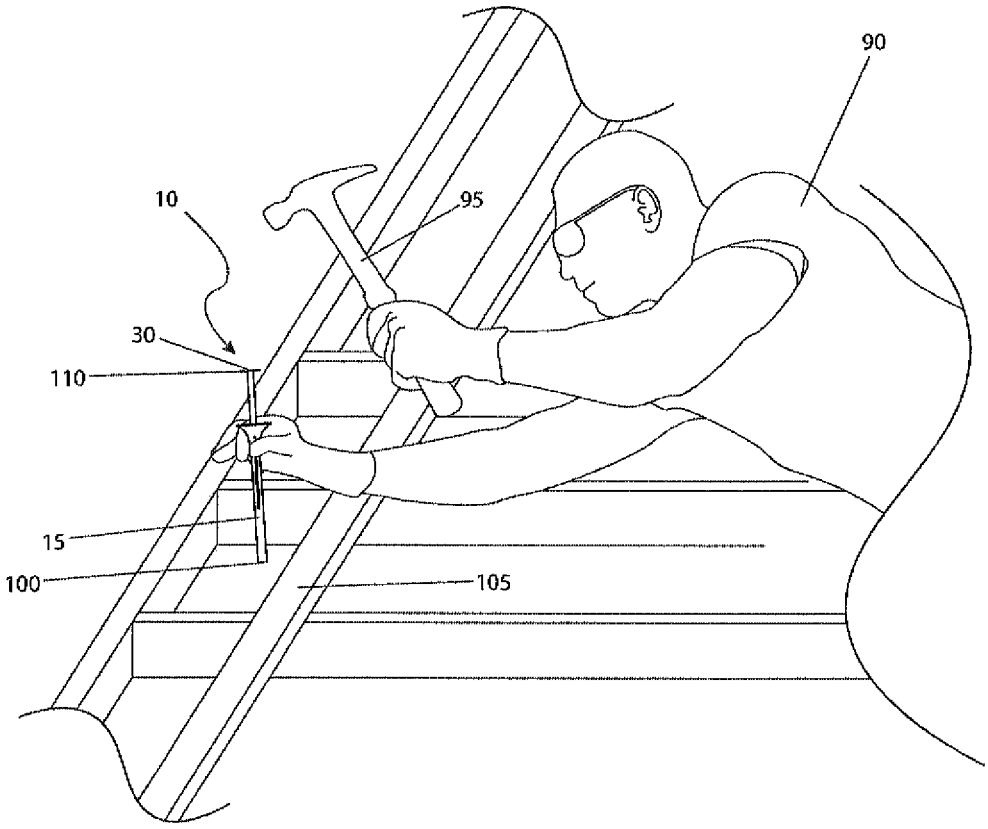

Referring to FIG. 5, a perspective view of the nail driving tool 10, shown in a utilized state, according to the preferred embodiment of the present invention is depicted. A user 90 grasps the outer sleeve 15 in one hand while holding a hammer 95 in the other. The tool 10, previously loaded with a nail (not shown due to illustrative limitations) as shown in FIG. 3, is located at a preferred nailing location 100. The preferred nailing location 100 may or may not be impacted by obstacles 105 which would normally negatively impact the swing of the hammer 95 under conventional hammering. The tool 10 thus raises the impact point 110 clear of the obstacles 105 and allows the nail to be easily driven home by repeated blows of the hammer 95 upon the striking head 30 of the tool 10.

2. Operation of the Preferred Embodiment

The preferred embodiment of the present invention can be utilized by the common user in a simple and effortless manner with little or no training. It is envisioned that the tool 10 would be constructed in general accordance with FIG. 1 through FIG. 5. The user would procure the tool 10 from conventional procurement channels such as tool distribution centers, home improvement stores, hardware stores, internet or mail order house or the like. Particular attention would be paid to the overall dimensions of the tool 10 to ensure proper and safe usage.

After procurement and prior to utilization, the tool 10 would be prepared in the following manner: the inner pin 20 would be withdrawn from the outer sleeve 15 by pulling the striking head 30 along a withdrawal travel path "ru" 70 until the retaining pin 45 is in an extended limit 55; a nail is then loaded into the hollow cavity until the nail head contacts the nail head contact surface 35. At this point in time, the tool 10 is ready for use.

During utilization of the tool 10, the following procedure would be initiated: the distal end of the tool 10 is placed at the preferred nailing location 100 such that any obstacles 105 are minimized; the user 90 then swings a hammer 95 such that it contacts the striking head 30 thus driving the inner pin 20 and subsequently the nail out of the outer sleeve 15; this action is repeated until the nail is completely driven home; the now empty tool 10 is removed.

After use of the tool 10, it is stored in its retracted state (as shown in FIG. 2) in a tool belt, toolbox, pocket, or similar location until needed again, where the above process is repeated in a cyclical manner.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A nail driving tool, consisting of:

an outer sleeve having an inner pin that slides back and forth inside the outer sleeve;

a striking head provided on a first end of the inner pin;

a nail head contact surface provided on a first end of the inner pin, the nail head contact surface and the inner pin extending out of the outer sleeve;

a restriction slot provided on a first side of the outer sleeve to keep the inner pin from separating from the outer sleeve when the nail driving tool is placed with the striking head in a downward facing position, the striking head is driven by an impact blow which drives the inner pin through the outer sleeve until the nail head contact surface is driven out of a first end of the outer sleeve;

a retaining pin slid from a retracted limit to an extended limit at an opposite end of the restriction slot;

an inner sleeve filling an interstitial space between the outer sleeve and the inner pin to increase stability and keep dust and dirt from an interior of the nail driving tool and hindering operation thereof, the inner sleeve is visible at the lower junction between the outer sleeve and the inner pin as well as an interior of the restriction slot; and a strike guard located at an upper end of the outer sleeve held in place with at least one retaining device;

wherein the inner pin is withdrawn from the outer sleeve by holding the outer sleeve while pulling the striking head along a withdrawal travel path until the retaining pin contacts an extended limit of the restriction slot;

wherein friction provided by the inner sleeve holds the inner pin within the outer sleeve, where such friction is then overcome with the impact blow;

wherein the outer sleeve is not magnetized; and wherein the inner sleeve is made of a material with a low coefficient of friction selected from the group consisting of polytetrafluoroethylene, polyimide, nylon, acetal, or polyester.

2. The nail driving tool according to claim 1, wherein the impact blow is from a hammer.

3. The nail driving tool according to claim 1, wherein the nail driving tool is transportable.

4. The nail driving tool according to claim 1, wherein the outer sleeve is made of a durable metal material.

5. The nail driving tool according to claim 4, wherein the outer sleeve is made of steel.

6. The nail driving tool according to claim 4, wherein the outer sleeve is made of titanium.

7. The nail driving tool according to claim 1, wherein the outer sleeve is five-eighths of an inch in diameter.

8. The nail driving tool according to claim 1, wherein the inner pin is three-eighths-of an inch in diameter.

9. The nail driving tool according to claim 1, wherein the retaining pin is permanently attached to the inner pin by an attachment method selected from the group consisting of pressing, welding, threading, or gluing.

10. The nail driving tool according to claim 1, wherein the strike guard is intended to protect the user's hands against accidental miss-strikes during use.

11. The nail driving tool according to claim 1, wherein the strike guard is permanently attached to the outer sleeve by welding.

12. The nail driving tool according to claim 1, wherein the nail driving tool is in the range of ten to thirty-six inches long.

* * * * *